US007658130B1

(12) United States Patent
Porteous

(10) Patent No.: US 7,658,130 B1
(45) Date of Patent: Feb. 9, 2010

(54) GOLF CLUB BOTTLE OPENER COMBINATION

(76) Inventor: Paul Porteous, 600 E. Hueneme Rd., Oxnard, CA (US) 93033

( * ) Notice: Subject to any disclaimer, the term of this patent is extended or adjusted under 35 U.S.C. 154(b) by 0 days.

(21) Appl. No.: 12/252,288

(22) Filed: Oct. 15, 2008

(51) Int. Cl.
*B67B 7/44* (2006.01)
*A63B 53/04* (2006.01)

(52) U.S. Cl. ..... 81/3.09; 7/151; 473/324

(58) Field of Classification Search ..... 81/3.09, 81/3.55; 7/151; D21/735–751; 473/324, 473/340

See application file for complete search history.

(56) References Cited

U.S. PATENT DOCUMENTS 2,608,889 A * 9/1952 Krupin ..... 81/3.09
2,745,301 A * 5/1956 Grunwald ..... 81/3.15
D240,947 S * 8/1976 Pomper ..... D21/735
4,330,128 A * 5/1982 Morelli ..... 473/307
5,377,977 A 1/1995 MacNeary
5,485,997 A * 1/1996 Schmidt et al. ..... 473/251
5,645,500 A 7/1997 Borden
5,779,558 A 7/1998 Britton
6,004,229 A 12/1999 Fazekas
D479,966 S 9/2003 Falt et al.
D480,284 S 10/2003 Falt et al.
D486,045 S 2/2004 Falt et al.
D518,684 S * 4/2006 Kushner ..... D7/507
7,250,006 B2 7/2007 McGonigle
D573,405 S * 7/2008 Bruce ..... D7/515

* cited by examiner

*Primary Examiner*—Hadi Shakeri
(74) *Attorney, Agent, or Firm*—Koppel, Patrick, Heybl & Dawson; Michael J. Ram

(57) ABSTRACT

A golf club suitable for use in driving or putting a golf ball comprising a club head attached to a shaft includes a bottle cap removal structure in a rear surface of the club head.

2 Claims, 4 Drawing Sheets

GOLF CLUB BOTTLE OPENER COMBINATION

The present application relates to a standard golf club which has a modified head that can also function as a bottle opener.

BACKGROUND

Golf is a popular sporting activity that provides physical exercise and the opportunity for the golfer to compete with other individuals, usually in a foursome. Because an 18 hole round of golf may take several hours, it is common for the golfers to bring along beverages such as sodas or beer in cans or bottles. While canned beverages usually include a pull tab in the lid and are readily opened, it is often preferred to imbibe bottled beverages which have crimped caps to seal the top of the bottle. On occasion the crimped caps can be twisted off. However, because the caps have sharp edges doing so can injure the hands of the user.

Accordingly, it is desirable to use a bottle opener to leverage off the cap. There are numerous examples of golf accessory tools which are used to hold a ball marker, clean golf shoe cleats or repair holes in the turf or greens. Several of these accessory tools may also include a knife, screw driver, or a bottle opening accessory. The golf accessory tool is typically small so that the golfer can carry it in his pocket or store it in a pocket of his golf bag. Unfortunately, these devices are often lost or become buried in the golf bag pocket under golf balls or other items stored in the pocket. U.S. Pat. Nos. 5,645,500 and 6,004,229 are representative examples of such devices. U.S. Pat. No. 7,250,006 is another example of a golf accessory tool which has similar functional parts. However, instead of being loose, this device is stored in a slot in the head of the shaft of a golf club. U.S. Pat. No. 5,377,977 is an example of a golf green repair tool permanently attached to the top of the shaft of a putter and U.S. Pat. No. 5,779,558 shows a removable plug in the head of a golf shaft which serves as a ball mark repair tool and holder for two ball markers.

U.S. Pat. Nos. D479,966, D480,284 and D486,045 show bottle openers with a golf motif but they are not designed to be carried on the golf course and are instead designed for use as a bar utensil. They depict a golf club head, such as a putter, iron or driver with a bottle opener attached to the hozzle thereof in place of the golf club shaft.

Because of the common desire of golfers on the golf course to have ready access to a bottle opener without having to search for a readily misplaced small tool there is a need for a more accessible bottle opener that the golfer will know is always available and accessible.

SUMMARY

A golf club suitable for use in driving or putting a golf ball, comprising a club head attached to a shaft, includes a bottle cap removal structure in a rear surface of the club head.

BRIEF DESCRIPTIONS OF THE DRAWINGS

DETAILED DESCRIPTION

Golfers often desire to have ready access to an opener for capped bottles while they are on the golf course. However, prior art pocket sized tools which include a bottle opener feature are often lost, misplaced or can not be readily located within the pockets of the golf bag. However, every golfer always carries various sized golf clubs in his golf bag. For example, a typical set of golf clubs includes a putter, several wood or metal drivers, several irons with different angled faces, typically numerically designated from a 1 iron to a 9 iron to designate the club face angle, and one or more specialty clubs such as a sand wedge and a chipping wedge. The golfer may also carry hybrid clubs, novelty clubs, as well as clubs that do not conform to USGA standards or other standards set forth by golf associates outside the US. The present invention addresses the need for a ready accessible bottle opener by providing a bottle opener construction mounted on or incorporated within the rear surface of the head of one or more golf club heads. Where the golf club head is in compliance with the USGA or other standards the bottle opener is incorporated in a manner that does not interfere with the compliance of that club head with those standards.

Numerous utility and design patents show various designs for removing pop-off and twist-off bottle caps. However, none of these designs are incorporated in the head of a golf club. Referring to FIGS. 1-5 a first embodiment of a golf club head incorporating a structure suitable for use in removing a pop-off cap 10 from a bottle 12, such as a beer bottle, is shown.

Figure 1:
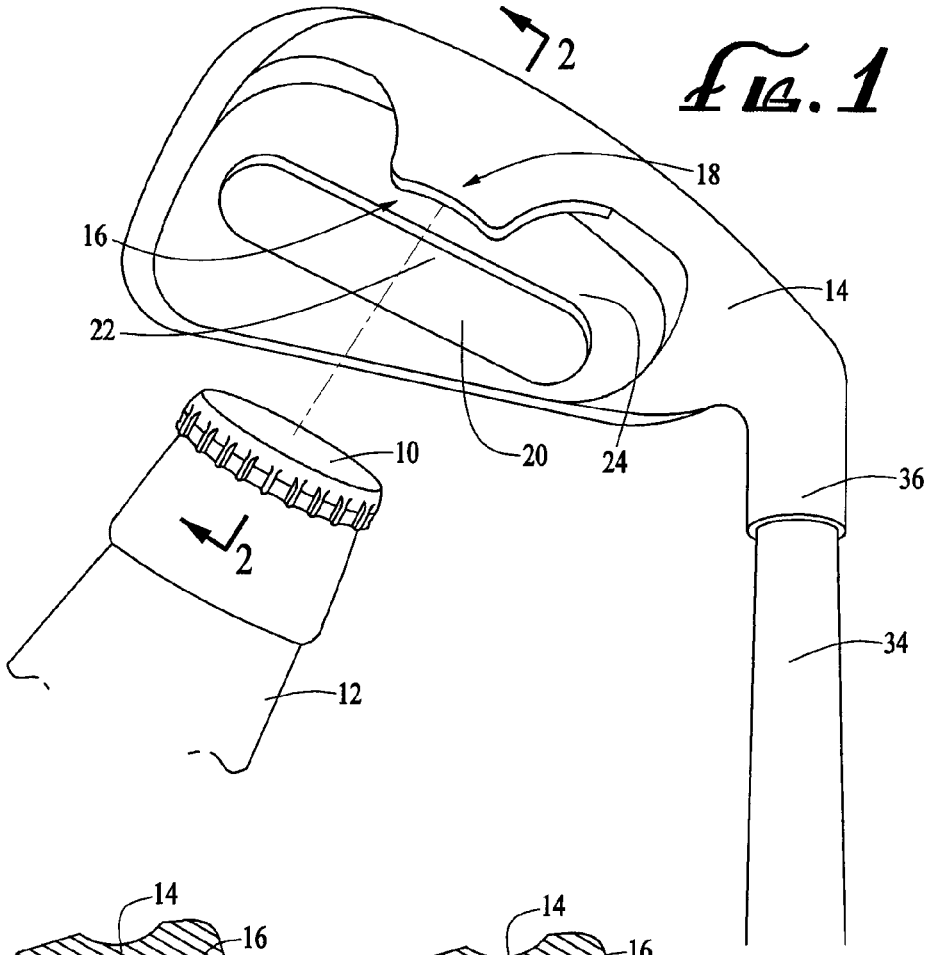
FIG. 1 is an enlarged perspective view showing a capped bottle adjacent the rear surface of a first embodiment of the head of a golf club incorporating features of the invention.
Figure 2:
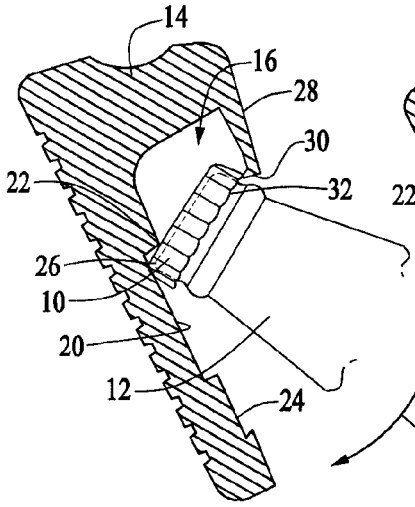
FIG. 2 is a cross sectional view of the golf club head of FIG. 1, taken along line 2-2 of FIG. 1, with the capped bottle positioned for opening.
Figure 3:
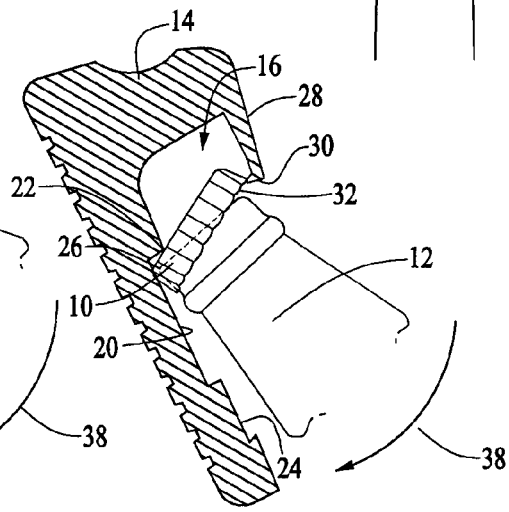
FIG. 3 is a cross sectional view of the golf club head of FIG. 1, taken along line 2-2 of FIG. 1, following opening of the capped bottle.

A standard head 14 of an iron is shown in FIG. 1 to include a cap removal structure 16 as part of the rear area 18 thereof suitable for leveraging the cap 10 from the bottle 12. As best shown in FIGS. 2 and 3 that cap removal structure 16 comprises an indentation 20 and a ledge 22 in the rear wall 24 suitable for receiving a first edge 26 of the bottle cap 10. Suitably spaced therefrom is an extension 28 which includes on a lower end thereto a lip 30 oriented at an angle to the extension 28 and pointing in the general direction of the rear wall 24. The extension 28 and lip 30 are spaced from the rear wall 24 a distance less than the diameter of the bottle cap such that when the first edge 26 of the bottle cap 10 is positioned in the indentation 20 and against the ledge 22 a lower edge 32 of the bottle cap rests on top of the lip 30. The cap can then be removed from the bottle by grasping the club head 14 or the shaft 34, preferably near the hozzle 36, and applying pressure to the bottom edge of the bottle 12 radially in the direction of the arrow 38 as shown in FIGS. 2 and 3.

Figure 4:
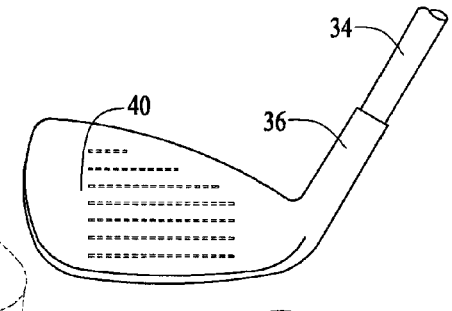
FIG. 4 is a front view of the golf club head of FIG. 1.
Figure 5:
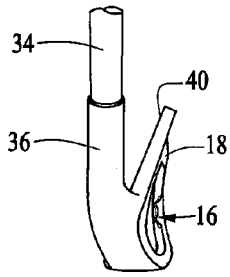
FIG. 5 is a side view of the golf club head of FIG. 1.
Figure 6:
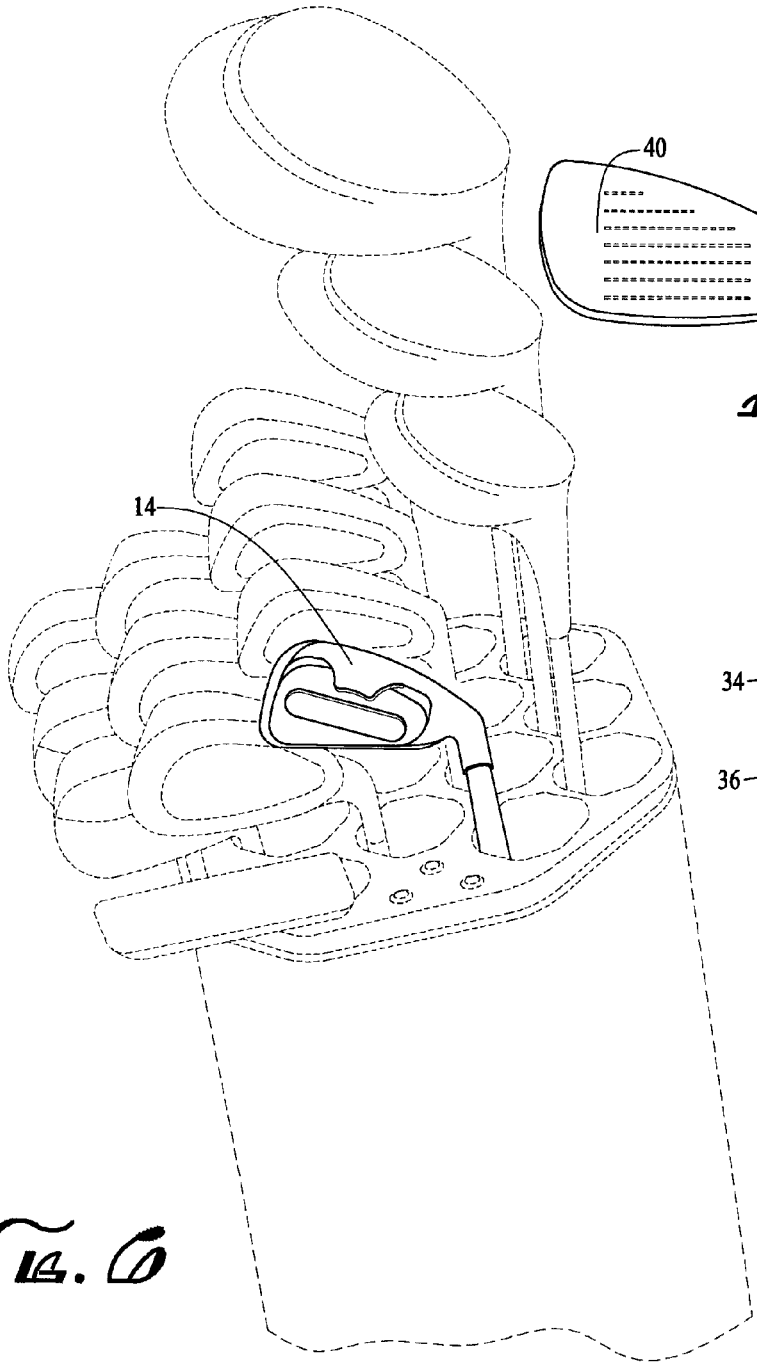
FIG. 6 shows the golf club of FIG. 1 in a golf bag containing several golf clubs with the bag and other clubs shown in dotted lines.

FIG. 4 is a front view and FIG. 5 is a side view of the embodiment of FIG. 1 showing the front surface 40 of the standard head 14 of an iron with the rear area 18 modified to include a bottle cap removal structure 16. As can be seen, the club head has a standard front surface 40 and standard profile with the club head being modified only by the addition of the bottle cap removal structure 16 in the rear surface of the club. As such, the modification does not change in any manner the use of the club for its intended purpose of driving golf balls. FIG. 6 shows the standard head 14 of an iron modified to include a bottle cap removal structure 16 placed in a golf bag with other standard clubs. While the bottle cap removal structure 16 may be added to any golf club, irrespective of whether the club is in compliance with the USGA or other standards, a key feature of the invention is that it can be incorporated into a standard club head without compromising the compliance with those standards. However, the invention is not limited to USGA or foreign club standards and may also be incorporated in a broad range of standard, hybrid or novelty clubs.

Figure 7:
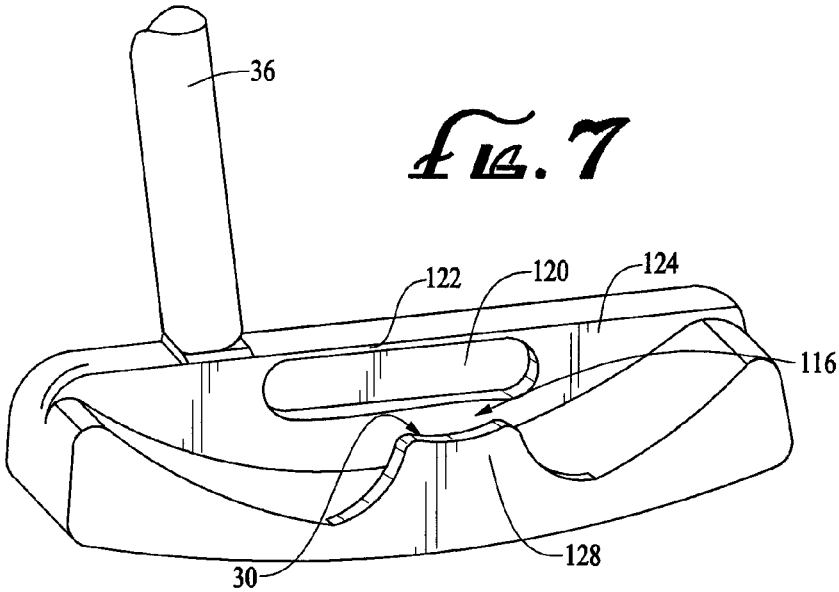
FIG. 7 is an enlarged perspective view showing the rear surface of a second embodiment of the head of a golf club incorporating features of the invention.
Figure 8:
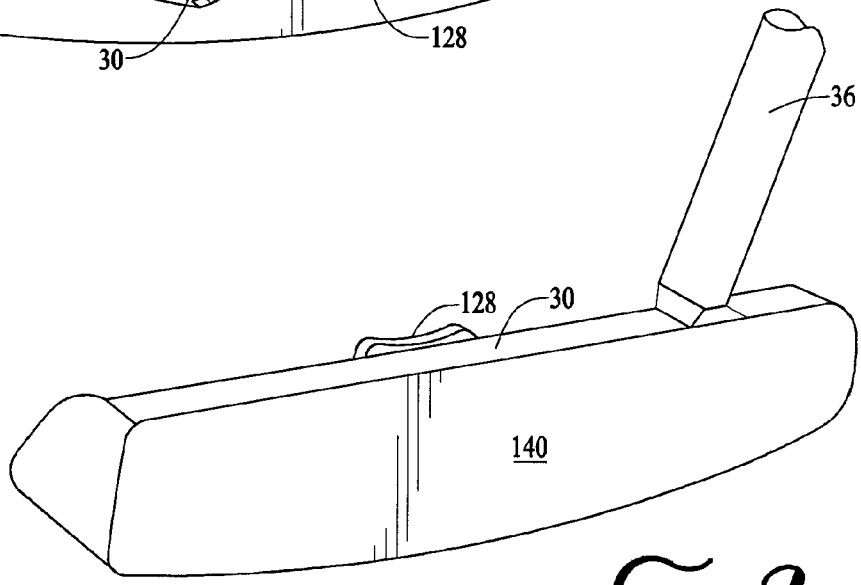
FIG. 8 is an enlarged perspective view showing the front surface of the embodiment of FIG. 7.

It is not intended that the inclusion of the bottle cap removal structure 16 be limited to irons such as shown in FIGS. 1-6. FIGS. 7 and 8 show a second embodiment incorporating a similar bottle cap removal structure 116 in the rear portion of a putter head 114. FIG. 7 is a rear perspective view illustrating a similar indentation 120 and ledge 122 in the rear wall 124. Spaced therefrom is an extension 128 which also includes a lip 30 such as shown in FIGS. 2 and 3 but which is not visible in the views of FIG. 7 or 8. The standard face 140 and profile of the putter 114, as in the prior embodiment, remains undisturbed by addition to the rear surface of the bottle cap removal structure 16

Figure 9:
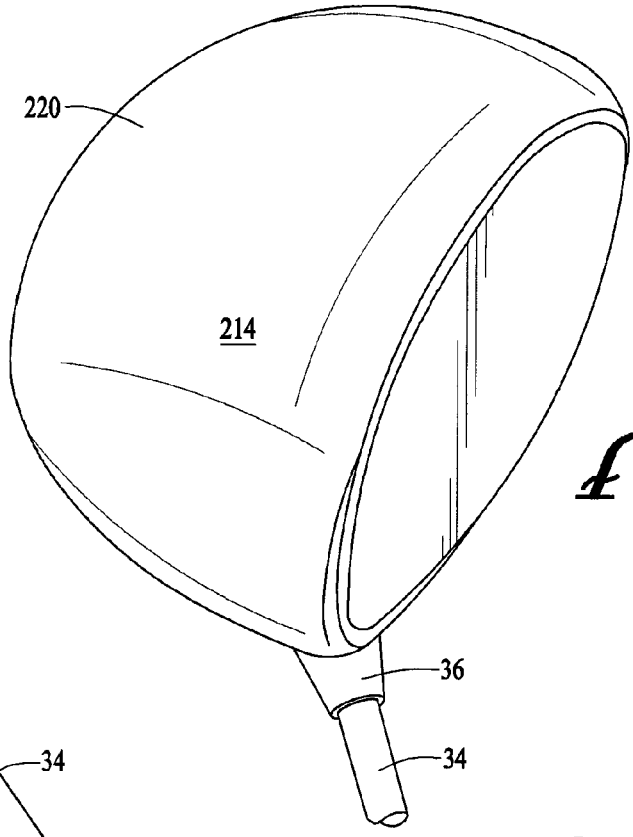
FIG. 9 is an enlarged perspective view showing the front surface of a third embodiment of the head of a golf club incorporating features of the invention.
Figure 10:
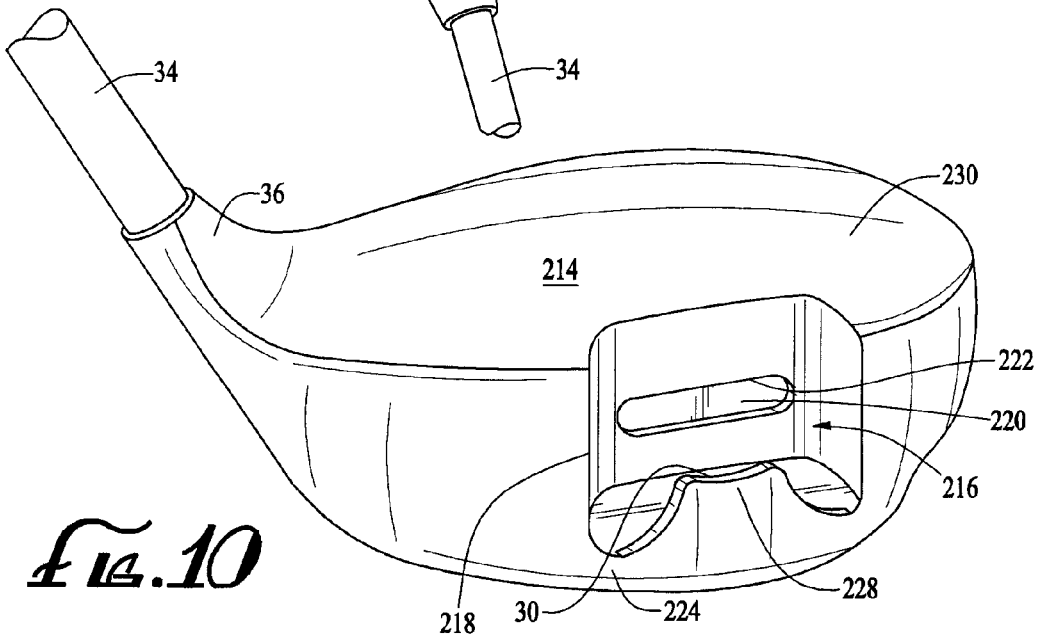
FIG. 10 is an enlarged perspective view showing the rear surface of the embodiment of FIG. 9 with the bottle opener feature incorporated therein.

FIGS. 9 and 10 show a third embodiment incorporating a similar bottle cap removal structure 216 in the rear portion of the head of a wood or metal driver 214. FIG. 10 shows the rear wall 224 of the driver with the bottle cap removal structure 216 in a cavity 218 in that rear wall 224, that cavity extending into the rear portion of the upper surface 230 of the club head. The bottle cap removal structure 216 includes an indentation 220, a ledge 222, extension 228 and a lip 30, which is not visible in the view shown which function in the same manner as like features in the first embodiment. However, the cavity 218 may also be only in the rear wall 224 of the driver, the upper surface 220 of the club head being unchanged in appearance from an unmodified club.

While the embodiments shown are directed to a particular design of bottle opener built into the rear surface of a golf club, one skilled in the art will recognize, based on the wide variety of openers for pop-off caps and twist caps shown in the prior art that different bottle cap removal structures could be incorporated in the rear surface of the different clubs. Further, the golf bag could include a single or multiple clubs with bottle openers in the club head or different clubs with different bottle cap removal designs.

I claim:

1. A golf club comprising a shaft and a club head, the club head comprising:

a) a club face comprising a ball striking front surface with a rear wall spaced therefrom, with an indentation in the rear wall of the ball striking surface, said indentation defining an edge, b) an extension in a club back surface, said extension spaced from the club face rear wall with an open area between the extension and said rear wall, said extension including a lip on an open end thereof, said lip oriented toward the said rear wall and wherein the indentation in the striking surface rear wall, the edge, the extension, the lip and the open area together define a bottle cap removal structure for removing a cap from a bottle.

2. The golf club of claim 1 wherein the extension is substantially parallel to the club face rear wall.

* * * * *